US005522223A

United States Patent [19]

Yanai et al.

[11] Patent Number: 5,522,223

[45] Date of Patent: Jun. 4, 1996

[54] PULSE TUBE REFRIGERATOR

[75] Inventors: Masayoshi Yanai; Etsuji Kawaguchi; Tomio Nishitani, all of Moriyama, Japan

[73] Assignees: Iwatani Sangyo Kabushiki Kaisha; Iwatani Plantech Corp., both of Osaka, Japan

[21] Appl. No.: 405,843

[22] Filed: Mar. 17, 1995

[30] Foreign Application Priority Data

Oct. 21, 1994 [JP] Japan ..... 6-256316

[51] Int. Cl.[6] ..... F25B 9/00

[52] U.S. Cl. ..... 62/6; 62/467

[58] Field of Search ..... 62/6, 467; 60/520

[56] References Cited

U.S. PATENT DOCUMENTS

| | | | |
|---|---|---|---|
| 3,817,044 | 6/1974 | Daniels | 62/6 |
| 5,269,147 | 12/1993 | Ishizaki et al. | 62/6 |
| 5,275,002 | 1/1994 | Inoue et al. | 62/6 |
| 5,295,355 | 3/1994 | Zhou et al. | 62/6 |
| 5,335,505 | 8/1994 | Ohtani et al. | 62/6 |
| 5,412,952 | 5/1995 | Ohtani et al. | 62/6 |
| 5,440,883 | 8/1995 | Harada | 62/6 |

OTHER PUBLICATIONS

"Analysis of Double Inlet Pulse Tube Refrigerator with a Valveless Stepped Piston Compressor", W. Peiyi, Z. Shaowei, C. Zhongqi, *Cryogenics*, 1990, vol. 30, Sep. Supplement, pp. 253–261.

*Primary Examiner*—Christopher Kilner
*Attorney, Agent, or Firm*—Bacon & Thomas

[57] ABSTRACT

A low-temperature end of a pulse tube (1) and a low-temperature end of a cold accumulator (2) are communicated with each other through an endothermic connection passage (3), so that refrigerant gas to be supplied from a compressor (7) to a high-temperature end of the cold accumulator (2) through a refrigerant gas passage (28) is introduced from the low-temperature end of the pulse tube (1) to the high-temperature end thereof through the cold accumulator (2) and the endothermic connection passage (3). A buffer tank (30) is connected to the high-temperature end of the pulse tube (1) through a first orifice (31). A sub gas passage (32) branched off from the refrigerant gas passage (28) is connected to the the buffer tank (30) through a second orifice (33).

5 Claims, 4 Drawing Sheets

PRIOR ART

PRIOR ART

PULSE TUBE REFRIGERATOR

BACKGROUND OF THE INVENTION

1. Field of the Invention

The present invention relates to a pulse tube refrigerator adapted to generate the cold at an endothermic portion by connecting a cold accumulator and a pulse tube to each other so as to supply and discharge gas to and from a compressor, and more specifically to a double inlet pulse tube refrigerator adapted to switch gas supply from a compressor to a high-temperature side of a pulse tube.

2. Description of Prior Art

Conventionally, as a pulse tube refrigerator which is capable of obtaining a lower attainable temperature there has been proposed a double inlet pulse tube refrigerator illustrated in FIG. 3 (described in the scientific essay "CRYOGENICS" September 1990). In this double inlet pulse tube refrigerator, a low-temperature end (5) of a pulse tube (50) is communicated with a low temperature end (53) of a cold accumulator (52) through an endothermic connection pipe (54) serving as a cold head so that gas to be supplied from a compressor (55) to a high-temperature end (57) of the cold accumulator (52) through a refrigerant gas passage (56) can be introduced from the low-temperature end (51) of the pulse tube (50) to a high-temperature end (58) thereof through the cold accumulator (52) and the endothermic connection pipe (54), a phase shifter comprising a needle valve (59) and a a buffer tank (60) is arranged in the high-temperature end (58), a branch gas passage (61) branched off from the refrigerant gas passage (56) is connected to a passage portion between the high-temperature end of the pulse tube (50) and the buffer tank (60), a needle valve (62) is arranged in the branch gas passage (61), and water coolers (63) (64) are disposed at the high-temperature ends of the cold accumulator (52) and the pulse tube (50) so as to apply a water cooling to the high-temperature end portions of the cold accumulator (52) and the pulse tube (50).

In this double inlet pulse tube refrigerator, since the high-temperature end portions of the cold accumulator (52) and the pulse tube (50) are adapted to be water-cooled, water coolers (63) (64) are directly connected to the refrigerator, which causes a problem that the refrigerator becomes large in size. Further, since the needle valve (59) is arranged between the pulse tube (50) and the buffer tank (60) as well as the needle valve (62) is arranged in the branch gas passage (61) connecting the refrigerant gas passage (56) to the passage portion between the high-temperature end portion of the pulse tube (50) and the buffer tank (60), there is a problem that the gas flow is disturbed by these needle valves (59) (62) to generate swirls. Additionally, in this double inlet pulse tube refrigerator, since the compressor section of the reciprocating type is rigidly connected to the cold generating section, there is also such a problem that vibrations of the compressor is transmitted to the cold generating section so that this refrigerator can't be used for cooling machinery and parts which hate vibrations.

Thereupon, the applicant of the present invention has proposed such a double inlet pulse tube refrigerator (disclosed in the Japanese Utility Model Laid Open Publication No. Hei. 5-47757) as to have a constitution illustrated in FIG. 4 as a small pulse tube refrigerator which is capable of cooling without vibrations. This previously proposed refrigerator has a compressor section (C) comprising a compressor (70), a cooler (71), an oil separator (72) and an oil adsorber (73) arranged in tandem, which is separated from a cold generating section (R), the supply and discharge of the refrigerant gas to and from the cold accumulator (74) constituting the cold generating section (R) being performed by the switching of a rotary valve (75) arranged between the compressor section (C) and the cold generating section (R), a gas reservoir (buffer tank) (78) made of a flexible tube being connected to the high-temperature end portion of the pulse tube (76) through a first orifice (77), and a sub gas passage (80) branched slantly from a main gas passage (79) for communicating the high-temperature end portion of the pulse tube (76) with the gas reservoir (78) being connected through a second orifice (82) to a refrigerant gas passage (81) for communicating the rotary valve (75) with the cold accumulator (74).

PROBLEMS PRESENTED BY THE PRIOR ART

But, in this conventional refrigerator, there still remains such a problem that pressure wave of the refrigerant gas to be supplied through the rotary valve (75) becomes pulse-like rectangular wave and a pressure change in an endothermic connection pipe (83) deviates from a certain delay angle of 90 degree relative to a pressure change in the compressor, so that the refrigerator hardly performs its full performance.

The present invention is directed to solving those problems. It is an object of the present invention to provide a double inlet pulse tube refrigerator which is small in size and light in weight, and has a high cooling efficiency.

SUMMARY OF THE INVENTION

For accomplishing the above-mentioned object, the present invention is characterized in that a high-temperature end of the pulse tube and a buffer tank are connected to each other through a first orifice, and a sub gas passage branched off from the refrigerant gas passage is connected to the buffer tank through a second orifice.

According to the present invention, since the high-temperature end of the pulse tube and the buffer tank are connected to each other through the first orifice and the sub gas passage branched off from the refrigerant gas passage is connected to the buffer tank through the second orifice, it is possible to obtain an ideal phase shifter effect in the first orifice by making the pressure wave within the buffer tank synchronous with the pressure wave of the main gas flow within the refrigerant gas passage and to enhance the cooling effect.

DETAILED DESCRIPTION OF PREFERRED EMBODIMENT

Figure 1:
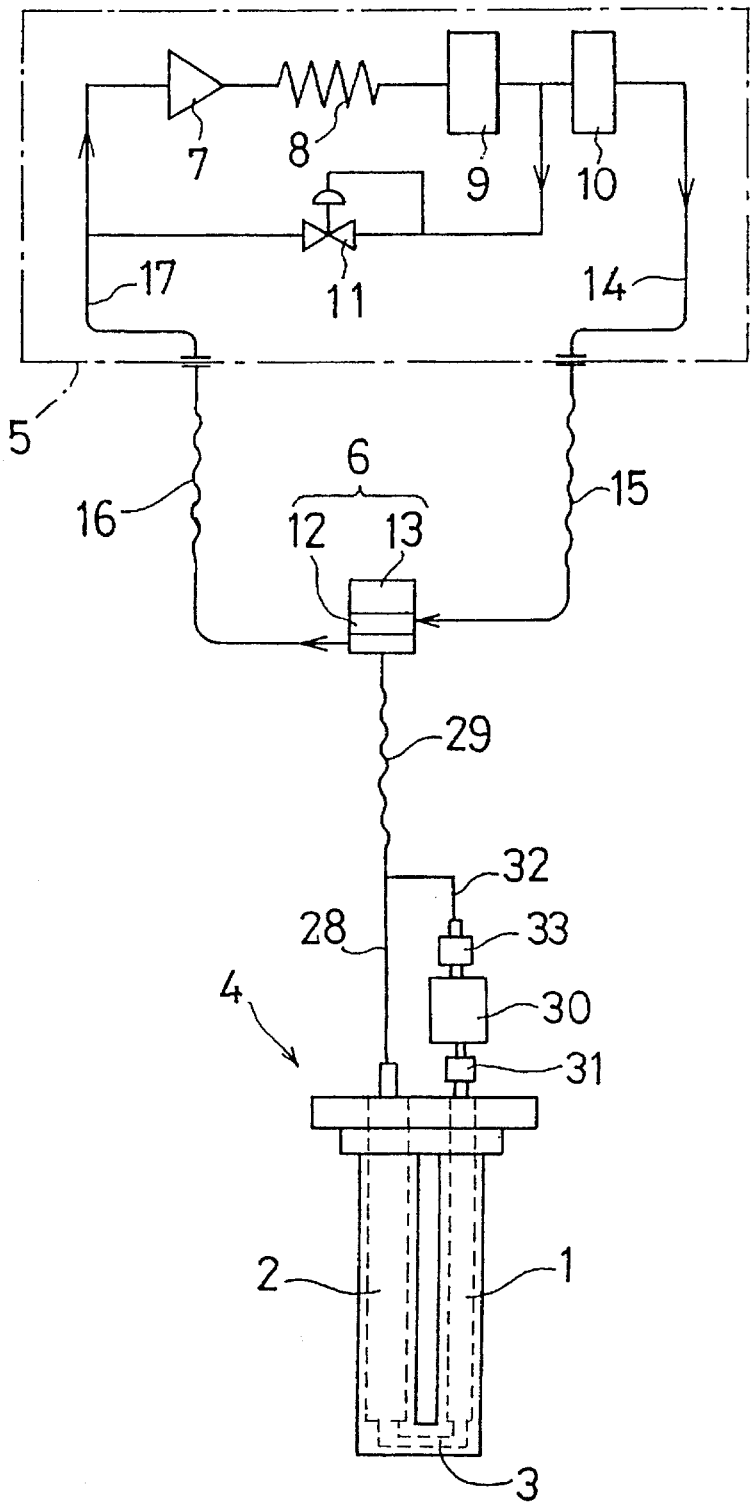
FIG. 1 is a schematic constitution view of a pulse tube refrigerator showing an embodiment of the present invention.
Figure 2:
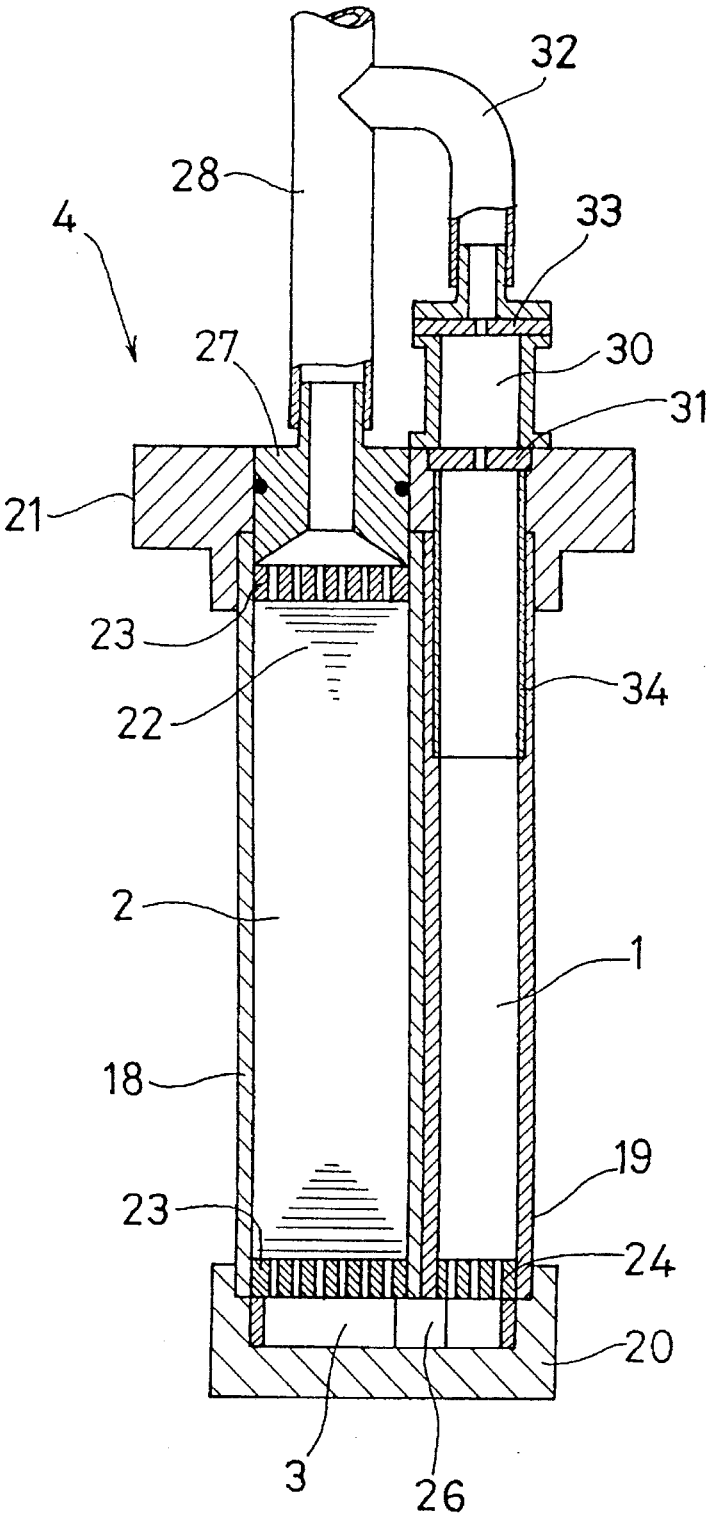
FIG. 2 is a vertical sectional view of a cold generating section of the embodiment of the present invention.
Figure 3:
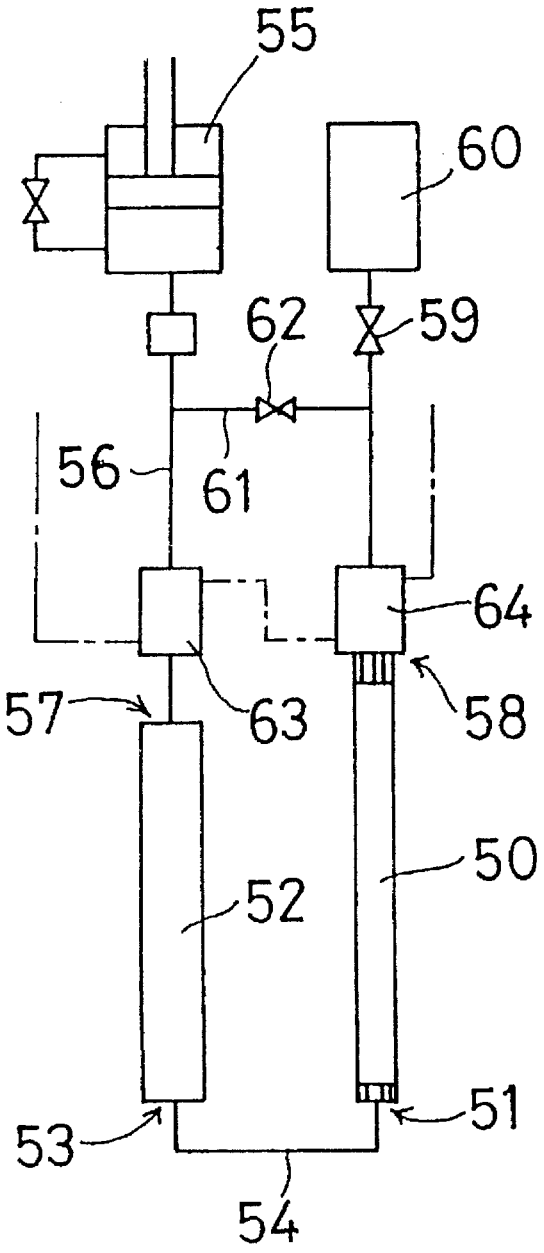
FIG. 3 is a schematic constitution view of a conventional double inlet pulse tube refrigerator.
Figure 4:
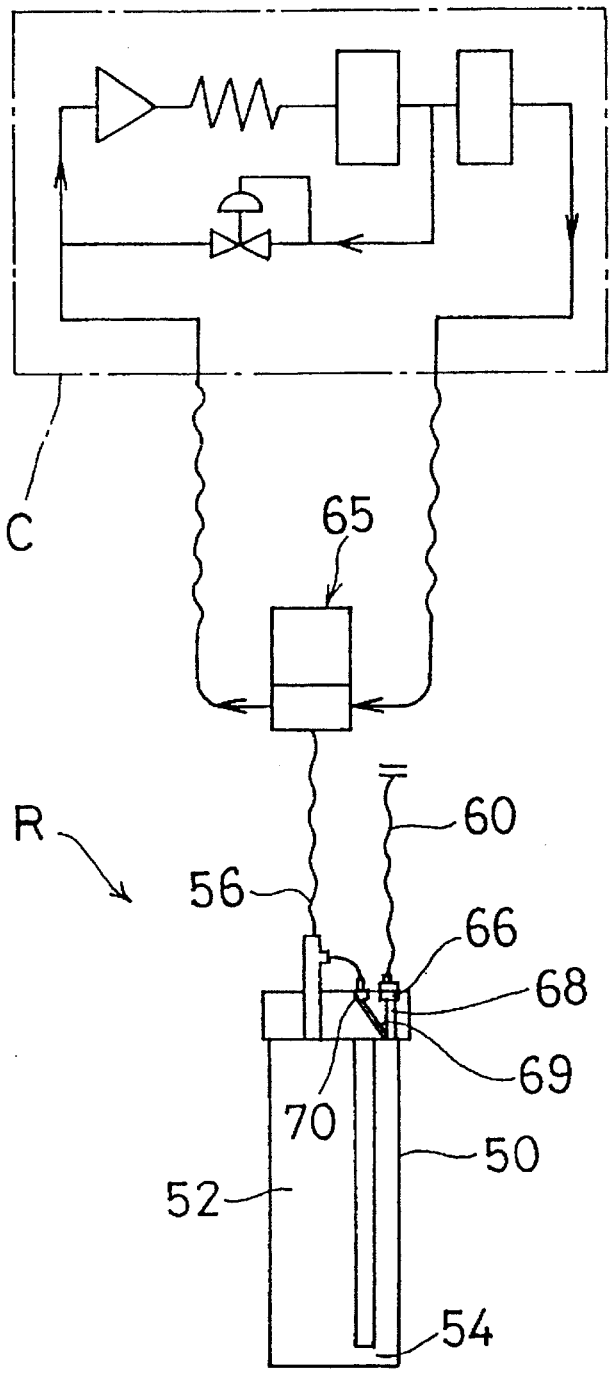
FIG. 4 is a schematic constitution view of a double inlet pulse tube refrigerator previously proposed by the applicant of the present invention.

This pulse tube refrigerator comprises a cold generating section (4) constituted by communicating one end portions of both a pulse tube (1) and a cold accumulator (2) with each other through an endothermic connection pipe (3), a compressor unit (5) and a rotary valve unit (6) for controlling the switching of supply and discharge of high-pressure gas generated in the compressor unit (5) to and from the cold generating section (4).

The compressor unit (5) comprises a compressor (7), a cooler (8), an oil separator (9), an oil adsorber (10) and a pressure keeping valve (11), and the rotary valve unit (6) comprises a rotary valve (12) and a valve driving motor (13). A high-pressure gas passage (14) conducted from the adsorber (10) is connected to a primary side high-pressure port of the rotary valve (12) through a flexible hose (15), and a flexible hose (16) conducted from the primary side low-pressure port of the rotary valve (12) is communicated with the compressor (7) through a low-pressure gas return passage (17).

The cold generating section (4) is constituted by arranging two stainless pipes (18) (19) in parallel, fitting their lower end portions into a copper end cap (20) and fitting their upper end portions into a stainless attachment flange (21). The cold accumulator (2) is constituted by stacking stainless mesh members (22) into one stainless pipe (18) and arranging flow straightening plates (23) at its upper and lower opposite end portions. The pulse tube (1) is constituted by arranging a flow straightening plate (24) at the lower end portion of the other stainless pipe (19).

The endothermic connection passage (3) is formed by mounting a spacer (26) to the copper end cap (20) to communicate the cold accumulator (2) with the pulse tube (1).

The upper end portion of the cold accumulator (2) is communicated with a gas induction plug (27) mounted to the attachment flange (21), and a refrigerant gas induction pipe (28) conducted from the gas induction plug (27) is communicated with a secondary port of the rotary valve (12) through a flexible hose (29). The high-pressure refrigerant gas generated in the compressor unit (5) is adapted to be supplied to the cold accumulator (2) by switching of the rotary valve (12).

On one hand, the upper end portion of the pulse tube (1) is communicated with a gas reservoir (buffer tank) (30) mounted to the attachment flange (21) through a first orifice (31). A sub refrigerant gas passage (32) branched off from the refrigerant gas induction pipe (28) is communicated with the upper end portion of the gas reservoir (30) through a second orifice (33).

Further, a liner (34) made of a good heat conductor is fixedly fitted into the inner surface of the portion near the upper end of the pulse tube (1). This liner (34) is disposed over about ¼ length of the upper end portion of the pulse tube (1), and its upper end portion is thermally connected to the attachment flange (21) to which the pulse tube (1) is mounted. Incidentally, an inner diameter of the liner (34) is made equal to an inner diameter of the pulse tube (1) at a portion to which the liner is not mounted.

In the pulse tube refrigerator having the above-mentioned constitution, the cold below a temperature (77 K.) of liquid nitrogen is generated in the portion of the copper end cap (20) by the pressure change of the high-pressure refrigerant gas flown into the pulse tube (1) through the cold accumulator (2). Further, in this case, since the cold generating section (4) is not provided with a movable portion as well as the rotary valve unit (6) for controlling the supply and discharge of the refrigerant gas to and from the cold accumulator (2) and the cold generating section (4) are communicated with each other by the flexible hose (29), it is possible to provide a refrigerator which doesn't vibrate.

Since the pulse tube (1) and the gas reservoir (30) are connected to each other through the orifice (31) as well as the gas reservoir (30) and the sub refrigerator gas passage (32) are connected to each other through the orifice (33), the gas flow is not disturbed as well as the pressure wave within the gas reservoir (30) generated by the sub gas flow flown into the gas reservoir (30) through the second orifice (33) can be made synchronous with the pressure wave of the main gas flow within the refrigerant gas induction pipe (28) so as to be able to have an ideal phase shifter effect in the first orifice (31) and to enhance the cooling effect.

Further, in this pulse tube refrigerator, since the liner (34) made of the good heat conductor is internally fitted to the portion near the upper end of the pulse tube (1) and this liner (34) is thermally connected to the attachment flange (21) in order to efficiently release a heat energy at the maximum temperature portion presented over a certain distance from the high-temperature end portion toward the low-temperature portion, the heat at the maximum temperature generated portion at a location remote a little from the upper end (the end portion on the high-temperature side) of the pulse tube (1) toward the low-temperature side thereof can be transmitted by the liner (34) to the attachment flange (21), so that the heat distribution in the pulse tube (1) can be made substantially linear to enhance the cooling efficiency as the cooler.

Since it is possible to make use of the high-pressure gas supplied from the compressor unit, the buffer tank can be formed small so that the whole of the refrigerator can be down-sized.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be considered as being included therein.

What is claimed is:

1. A pulse tube refrigerator including a pulse tube (1) and a cold accumulator (2) both of which low-temperature ends are communicated with each other through an endothermic connection passage (3), wherein refrigerant gas to be supplied from a compressor (7) to a high-temperature end of the cold accumulator (2) through a refrigerant gas passage (28) is introduced into the low-temperature end of the pulse tube (1) through the cold accumulator (2) and the endothermic connection passage (3) and then is delivered to the high-temperature end of said pulse tube (1), wherein a buffer tank (30) is connected to the high-temperature end of the pulse tube (1) through a first orifice (31), and a sub gas passage (32) branched off from the refrigerant gas passage (28) connected to the high-temperature end of the cold accumulator (2) is connected to the buffer tank (30) through a second orifice (33).

2. A pulse tube refrigerator as set forth in claim 1, wherein a liner (34) made of a good heat conductor is fixedly fitted into an inner surface portion of the high-temperature end of the pulse tube (1) over a certain range and the liner (34) is thermally connected to an attachment flange (21) positioned at the high-temperature end of the pulse tube.

3. A pulse tube refrigerator comprising:

a pulse tube having a low-temperature end and a high-temperature end;

a cold accumulator having a low-temperature end and a high-temperature end;

an endothermic connection passage interconnecting the low-temperature end of said pulse tube and the low-temperature end of said cold accumulator;

a refrigerant gas passage connected to the high-temperature end of said cold accumulator, said refrigerant gas passage being adapted to be supplied with a refrigerant gas from a compressor to be delivered to the high-temperature end of said pulse tube through said cold accumulator and said endothermic connection passage;

a buffer tank connected to the high-temperature end of said pulse tube through a first orifice; and a sub gas passage interconnected between said refrigerant gas passage and said buffer tank, said sub gas passage opening into said buffer tank through a second orifice.

4. The pulse tube refrigerator as set forth in claim 3, further comprising a high heat conductive liner fixedly fitted into an inner surface portion of the high-temperature end of the pulse tube.

5. The pulse tube refrigerator as set forth in claim 4, further comprising an attachment flange interconnecting the high temperature ends of said pulse tube and said cold accumulator, said liner being thermally attached to said attachment flange.

* * * * *